United States Patent [19]

Lanfermann

[11] 4,082,361

[45] Apr. 4, 1978

[54] RACK DEVICE FOR A MINING MACHINE

[75] Inventor: Willy Lanfermann, Bochum, Germany

[73] Assignee: Gebr. Eickhoff, Maschinenfabrik und Eisengiesserei m.b.H., Bochum, Germany

[21] Appl. No.: 702,890

[22] Filed: Jul. 6, 1976

[30] Foreign Application Priority Data

Jul. 10, 1975 Germany ..... 2530754

[51] Int. Cl.[2] ..... E21C 29/02

[52] U.S. Cl. ..... 299/43; 105/29 R

[58] Field of Search ..... 299/43, 42; 105/29 R

[56] References Cited

U.S. PATENT DOCUMENTS

| | | | |
|---|---|---|---|
| 1,435,341 | 11/1922 | Sheal | 105/29 R |
| 3,753,596 | 8/1973 | Pentith | 299/43 |
| 3,784,258 | 1/1974 | Braun | 299/43 |

FOREIGN PATENT DOCUMENTS

| | | | |
|---|---|---|---|
| 1,069,655 | 11/1959 | Germany | 105/29 |
| 331,597 | 11/1919 | Germany | 105/29 |
| 1,292,076 | 10/1972 | United Kingdom | 299/43 |

*Primary Examiner*—Ernest R. Purser

*Assistant Examiner*—William F. Pate, III

*Attorney, Agent, or Firm*—Thomas H. Murray

[57] ABSTRACT

A rack device extends along the side wall of a face conveyor for a mining machine and essentially includes a plurality of elongated rack segments supporting spaced-apart drive members along the length of each segment. The rack segments are joined together in an end-to-end relation by a rod member passed through an eyelet opening in extensions projecting from the rack segments. The rod member is arranged at the joint between rack segments such that the rod member lies between, preferably midway between, adjoined sections of the face conveyor. A duct extends between the side wall of the face conveyor and a spill plate which is formed by a plurality of plate members arranged side-by-side to extend along the face conveyor. The duct has upstanding side walls with openings to receive and support the rod member used to join together the rack segments. The openings in the extensions of the rack segments as well as the openings in the side wall of the duct member are elongated for limited longitudinal movement of the rack segments in relation to the face conveyor. Further details and modifications are disclosed.

22 Claims, 8 Drawing Figures

RACK DEVICE FOR A MINING MACHINE

BACKGROUND OF THE INVENTION

This invention relates to a rack device which is provided with drive members and mounted at the side wall of a face conveyor or a spill plate for guiding and moving a mining machine, particularly a drum-cutter type mining machine. The rack device is drivingly engaged by means of at least one driven sprocket wheel or with at least one endless circulating drive chain coupled to a drive shaft on the mining machine.

It is known in the art in regard to chain-driven coal cutters to produce their advancing motion by means of a rope which is coiled about a pulley. The rope drives a transmission on the coal cutter which includes a gearwheel forming means engageable with a rack to move the drum cutter along the working face of a mine. The rack comprises a channel section arranged so that its side members face the floor. The web section is provided with a series of apertures arranged at spaced-apart locations along the length of the channel. The gearwheel, driven by the transmission on the chain coal cutter, has teeth which engage the apertures in the web section to propel the machine along the channel section.

It is also known in the art to arrange an angle trough for guiding a drum cutter along the mine face. A vertically-arranged member of the angle trough is mounted onto a conveyor at its side wall nearest the working face of the mine. The vertically-arranged member is bent along its top edge toward the coal face so that the bent edge together with an approximately Z-shaped cross-sectional strip, form a box-shaped trough which is open at its top. A flat-link chain, resiliently mounted at both ends, is situated in the trough and positively retained therein by the horizontally-arranged top edge of the strip and by the vertical faces of the angle trough member. The construction is such as to prevent the flat-link chain from lifting out of the trough. The drum cutter engages, by means of two driven chain sprockets, the flat-link chain which functions in this instance as a rack, to move the cutter machine along the coal face.

A spill plate for chain scraper converyors is also known in the art where the spill plate consists of individual sections having equal lengths with each length corresponding to the length of the scraper chain conveyor sections to which it is attached. The joints between the spill plate sections are offset by approximately half the length of a trough section to enable the spill plates to be utilized for stiffening the conveyor. The conveyor may take the form of a loader conveyor which is situated in the gallery.

In the initially-described form of known rack, the individual sections are joined to each other by permanently riveting fishplates onto both sides of the rack at the joints. The known form of rack described thereafter comprises a flat-link chain which is stretched along the entire length of the angle trough and is resiliently retained at both ends. The first-mentioned rack configuration is for all practical purposes rigid and is not adaptable to follow along the run of a floor or accommodate continuous resetting or advancing motion of the face conveyor. On the other hand, when a rack is formed by a flat-link chain, the rack is capable of adapting itself to the shape of the floor but it is immovable in the horizontal direction and is, therefore, not very suitable for use with a face conveyor adapted for advancing movement.

SUMMARY OF THE INVENTION

It is an object of the present invention to provide a rack which is suitable for guiding and moving a mining machine, particularly a drum-cutter type mining machine, wherein the rack does not hinder the resetting or advancing motion of the face conveyor by improving the construction of the rack and mounting the rack upon the side wall of a face conveyor or upon a spill plate in such a way that the rack is adaptable to the run of the floor and constantly provides reliable engagement with a driven sprocket wheel or drive chain carried on the mining machine for traversing movement thereof along the face conveyor.

More specifically, the present invention provides in combination with a mining machine, a rack device at the side wall of the face conveyor which includes a plurality of conveyor trough sections arranged end-to-end for extending along in a generally horizontal path of travel by the mining machine, the rack device including in combination a plurality of elongated rack segments having spaced-apart drive members along the length of each segment, means to support the opposite ends of the rack segments at the side wall of the face conveyor for pivotal movement about horizontal axes, the means to support being arranged to maintain a gap between the ends of adjacent rack segments while at least some of the rack segments bridge and maintain a gap between the adjacent ends of the conveyor trough sections for unimpeded vertical movement and horizontal pivotal movement between the conveyor trough sections, and a rotating element on the mining machine for driving engagement with the drive members of the rack segments to propel the mining machine along its course of travel.

Thus, the present invention proceeds from a recognition of the problems presented by the known prior art rack driver arrangements and provides that a rack device is subdivided into individual rack segments which advantageously bridge the joints of the conveyor trough portions or spill plate portions by a distance corresponding to half their length. The rack segments or portions are connected at both ends to the conveyor trough sections or spill plate sections in a manner so as to be pivotal about the horizontal axes while maintaining a gap that does not impede vertical motion of the conveyor trough sections and maintains the conveyor trough sections at a distance from each other which does not impair their horizontal pivotal movement. Each rack segment which bridges the joints between two adjacent trough sections or spill plate sections connects these sections together for vertical pivotal movement about horizontal axes and also horizontal pivotal movement within manufacturing clearances within the joint. The rack segments participate to a substantially reduced degree in the vertical pivoting of the individual conveyor trough sections or spill plate sections resulting from an undulating floor. The rack segments are situated on a line substantially with the path of movement of the driving sprocket or of the driving chain which corresponds to the course of travel by the mining machine. The driving chain sprocket or driving chain of the mining machine can roll along the rack segments substantially without shock, notwithstanding a vertical offset relation between the adjacent ends of the rack portions and a pitch error between two drive members at the joint of adjacent rack segments.

Appropriately, the length of the individual rack segments corresponds to the length of a section of the face conveyor or spill plate but, more particularly, the length of the individual rack segments corresponds to half the length of the conveyor or spill plate section. By employing this concept, it is also possible to provide two rack segments arranged successively, with lengths so that their aggregate length corresponds to the length of a conveyor trough section or spill plate section. The shorter rack segment is arranged to bridge the joint between adjacent trough sections or spill plate sections. Directional differences along which the successive rack segments may extend can, therefore, be more effectively minimized and even avoided.

The individual rack segments include two strips which are joined to each other by drive members to thereby define the desired dimension of the rack segment. The top surfaces of the strips at their terminal ends are preferably tapered in a manner of a ramp. At least one of the strips is provided with extensions having eyelet openings which are adapted to accommodate a mounting shaft. To provide the desired mechanical strength for the drive members, these members extend with converging side surfaces toward the bottom edge of the strips. Drive members having this form are located, at least, at the end regions of the rack segments.

According to a further feature of the present invention, the eyelet openings at the ends of the rack extensions are also arranged symmetrically with respect to the joint whereby they are laterally offset with respect to each other in a manner so that two adjacent rack portions are joined together in the form of a hinge by means of a common link shaft. One of the two extensions used to form a joint between rack segments, may be constructed as a clevis according to a modified form of the present invention. The clevis encloses a tongue formed by an extension from an adjoining rack segment. The link shaft, if desired, is situated in or near the horizontal plane of symmetry of the drive members whereby the link shaft serves the additional function as a drive member or forms a shaft for a drive member. In this way, any pitch errors at the joint between rack segments are further reduced or completely eliminated.

According to another feature of the present invention, the link shaft which joins two rack segments together in the manner of a hinge is also employed to connect the rack segments to the face conveyor or the spill plate. This alleviates the need for a separate mounting bolt which would otherwise function merely to connect the rack to the face conveyor or spill plate.

A duct situated between the side spill plate and the side wall of the trough conveyor accommodates the extensions of the rack segments containing the link shaft. The duct retains the link shaft while it extends through the spill plate and through openings in the extensions of the rack segments. The link shaft extends transversely to the direction of material transportation by the face conveyor.

The aforementioned link shaft forming the hinge connection between the rack segments also, in effect, joins together the trough sections or spill plate sections. The link shaft is arranged to have limited movement in the longitudinal direction of the face conveyor or with respect to the spill plate. A suitable dimensioning to the range of movement provides the pivoting facilities between adjacent trough sections to be adapted to a desired order of magnitude independent of the manufacturing tolerance at the rack joints. To this end, the present invention further provides that the link shaft which projects from the rack segments and joins them together in a hinged manner, is extended for engagement into horizontal slots in the duct walls where they are retained therein.

According to a further feature of the present invention, the rack device situated at the stowing side and/or working side of the face conveyor functions to define the traversing path for the skids on the mining machine and can also function as guiding means which prevents vertical movement by the skids and, therefore, the mining machine. The mining machine is, therefore, guided by the rack device so that the sprockets or the endless drive chain coupled to a winch drive on the machine cannot be lifted out of the teeth formed as part of the rack device.

These features and advantages of the present invention as well as others will be more readily understood when the following description is read in light of the accompanying drawings, in which.

Figure 1:
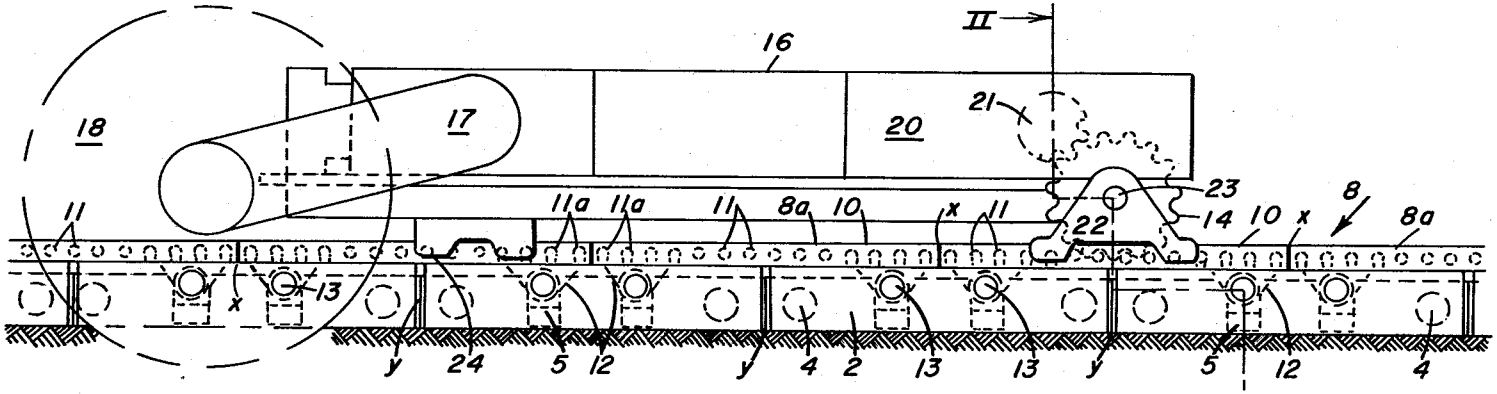
FIG. 1 is a side elevational view of a rack device embodying the features of the present invention for propelled movement by a drum-type cutter machine along a mine face.
Figure 2:
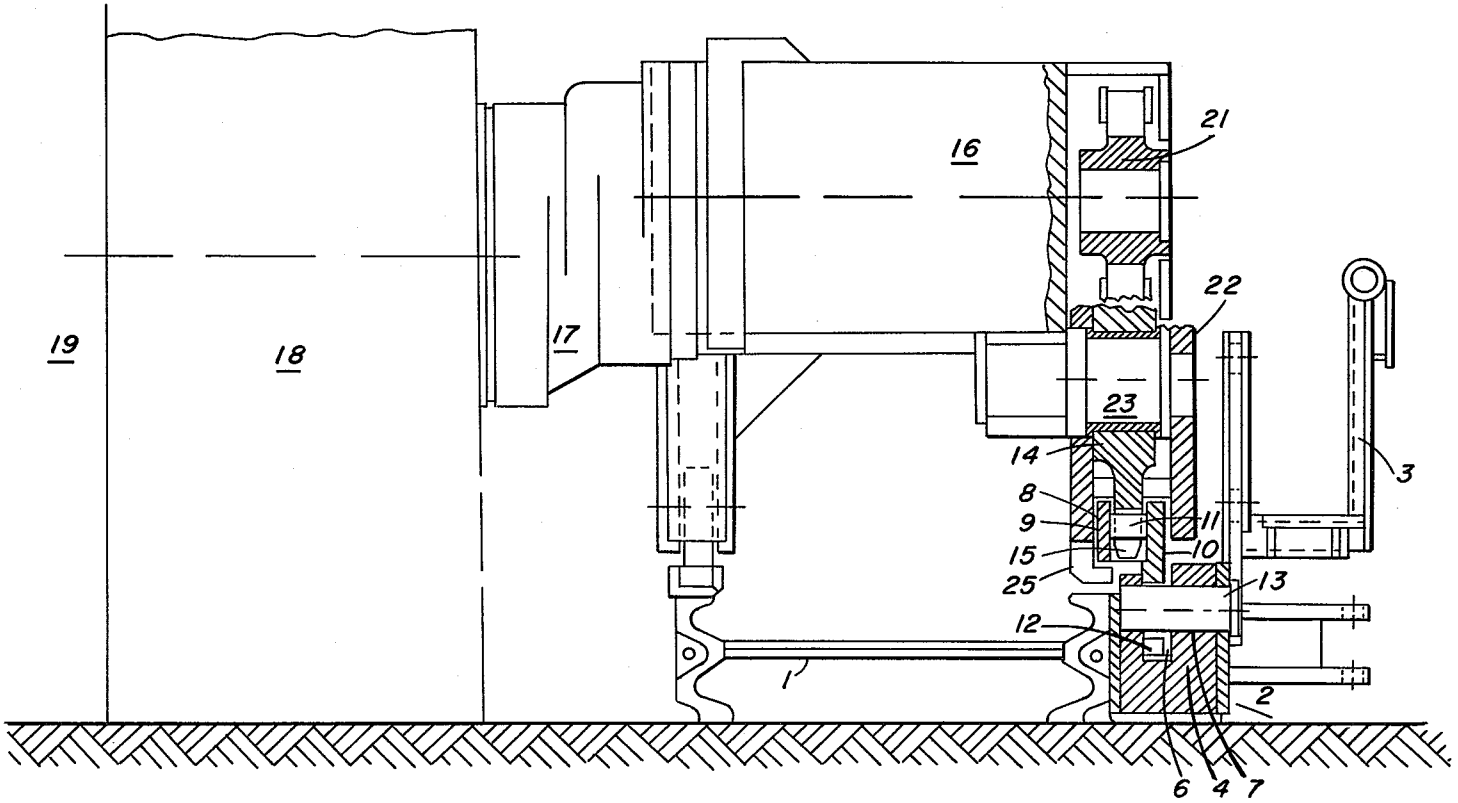
FIG. 2 is a sectional view taken along line II—II of FIG. 1.
Figure 5:
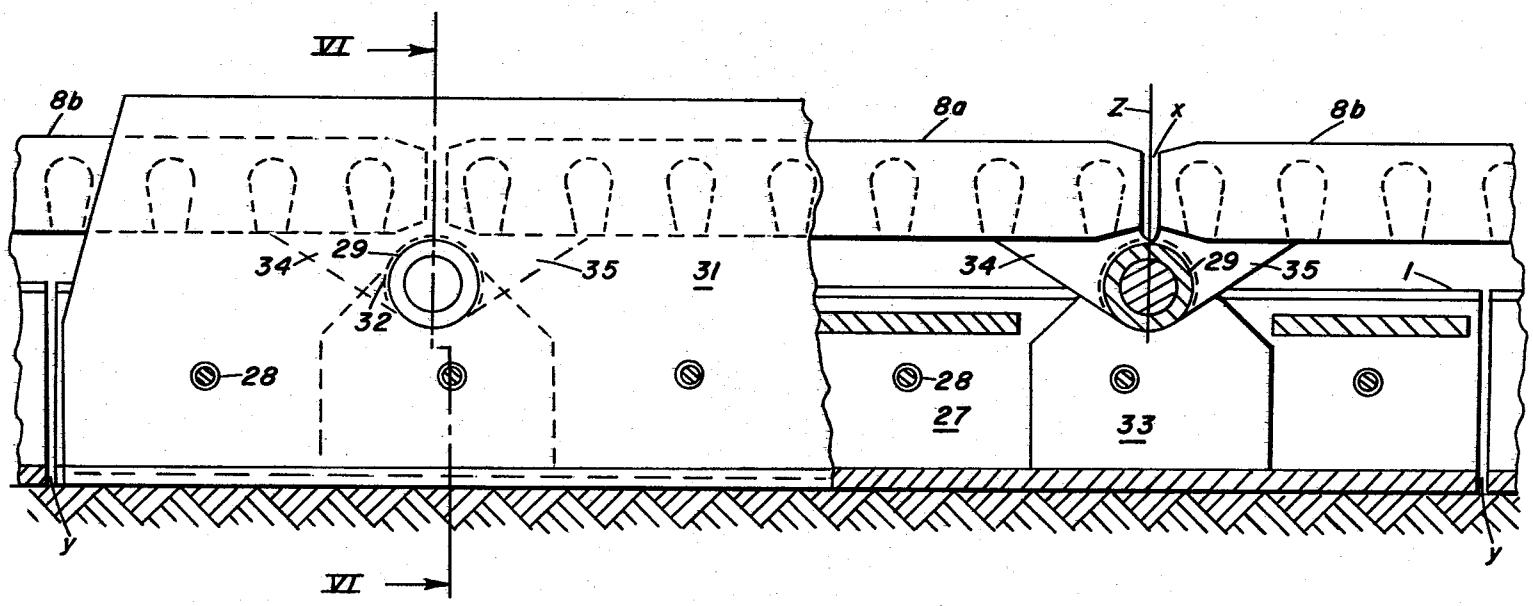
FIG. 5 is an enlarged side elevational view of a further embodiment of a rack device according to the present invention.
Figure 7:
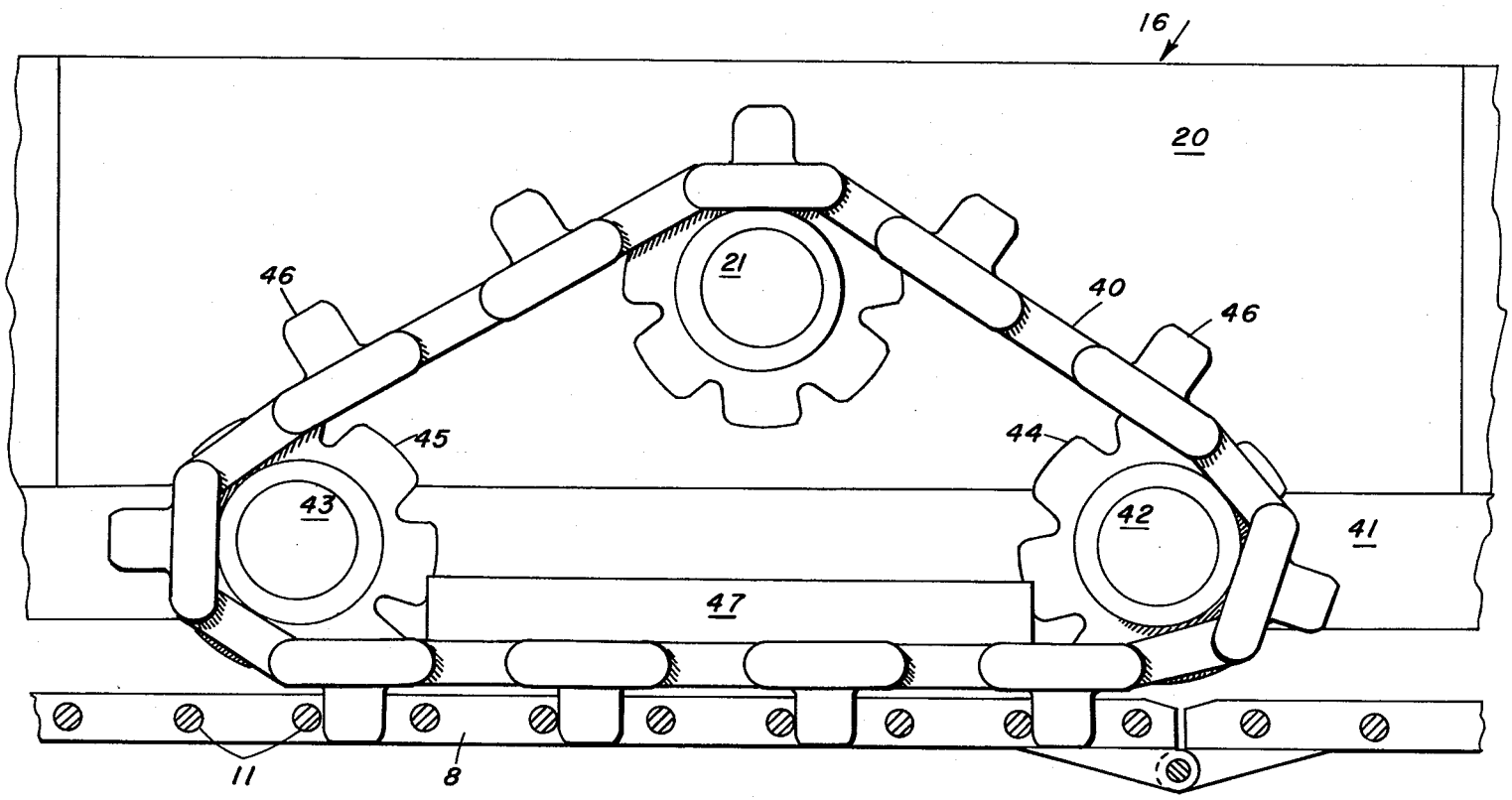
FIG. 7 is a partial side elevational view of a rack device according to the present invention illustrating an endless chain forming part of drive means for propelling a mining machine along a mine face.

As shown in the drawings, and with particular reference to FIGS. 1 and 2, a face conveyor 1 includes a plurality of conveyor trough sections arranged end-to-end to extend along in a generally horizontal direction corresponding to the path of travel of a mining machine. The individual conveyor trough sections are interconnected along the stow side thereof with a box-shaped duct 2 which is, in turn, connected to a side spill plate 3. The side spill plate is subdivided into spill plate sections of equal length and arranged side-by-side to extend along the length of the face conveyor. The duct 2 is also subdivided into sections having a length corresponding to the length of a conveyor trough section. The duct sections are bolted onto the side wall of the face conveyor at the stow side. The duct includes spacers 4 and 5 which are situated at the region of the ends of the conveyor trough sections. Spacers 4 comprise short tubular sections and spacers 5, disposed between the spacers 4, are constructed in the form of a block having a longitudinal slot 6 opening out of the top surface of the spacers 5 and extending parallel to the face conveyor 1. A bore 7 in each spacer 5 extends transversely to the direction of transportation of materials by the face conveyor. The bore 7 is in open communication with the slot 6. A rack device 8 is positioned to extend along in the longitudinal direction of the conveyor. The rack has extensions projecting into the slot 6 of the spacers 5. The rack shown in FIG. 1 is subdivided into rack segments 8*a* each having a length equal to the length of a conveyor section forming the face conveyor 1, or equal to the length of a spill plate section forming the side spill plate 3. The rack segments each includes two spaced-apart strips 9 and 10 which are rigidly interconnected to each other by means of drive members 11. The upper surface of both ends of the strips 9 and 10 is tapered to form a ramp as best shown in FIGS. 5 and 7. Only strip 10 of each rack segment has an extension 12 with a drilled opening therein arranged adjacent the end of each rack segment. Each extension 12 extends into the slot 6 of spacer 5 where it is supported by a wall at the bottom of slot 6 and retained therein by a bolt or shaft 13. As shown in FIGS. 1 and 2, the shaft 13 extends into the bore 7 and passes through the opening in extension 12.

The drive member 11 extend transversely to the extended length of the rack segments and serve to provide a stable interconnection between the strips 9 and 10. The drive members are normally cylindrical. However, drive members 11*a* in the region of the extension 12 have side surfaces that converge toward the bottom edge of the drive members. The converging side surfaces of the drive members in the region of extensions 12 extend to the bottom edge of the strip to increase the stiffness and stability of the rack segments 8*a* but without impairing the required engaged relation with a sprocket wheel 14 on the mining machine.

Each of the rack segments 8*a* is provided only at its two ends with a bottom extension 12 which is engaged with the spacer 5. The joints between the conveyor sections forming face conveyor 1 and the joints between the spill plate sections forming spill plate 3 are offset with respect to the joints between the rack segments. This offset relation corresponds to one-half the length of the rack segments 8*a*. A gap X is formed between the adjacent ends of the rack segments 8*a*. The width of gap X is such that the conveyor trough sections can be vertically pivoted with respect to each other.

The chain sprocket wheel 14 is carried on the mining machine which is in the form of a drum-cutter mining machine 16 and traversed upon the face conveyor 1 incident to working a coal seam 19 by means of a drum cutter 18. The drum cutter 18 is supported in the usual well-known manner for vertical adjustment by a support arm 17. The sprocket wheel 14 is driven by a winch 20 on the drum-cutter mining machine 16 through a chain sprocket wheel 21. The sprocket wheel 14 is supported with a machine skid 22 by a support shaft 23 so as to be rotatable about the horizontal axis. The skid 22 at the rear of the mining machine engages the rack 8 in the same manner as a machine skid 24 at the leading end of the mining machine. A support arm 25 extends beneath the rack in order to maintain the teeth 15 of the chain sprocket wheel 14 in meshing engagement with the drive members of the rack segments.

Figure 3:
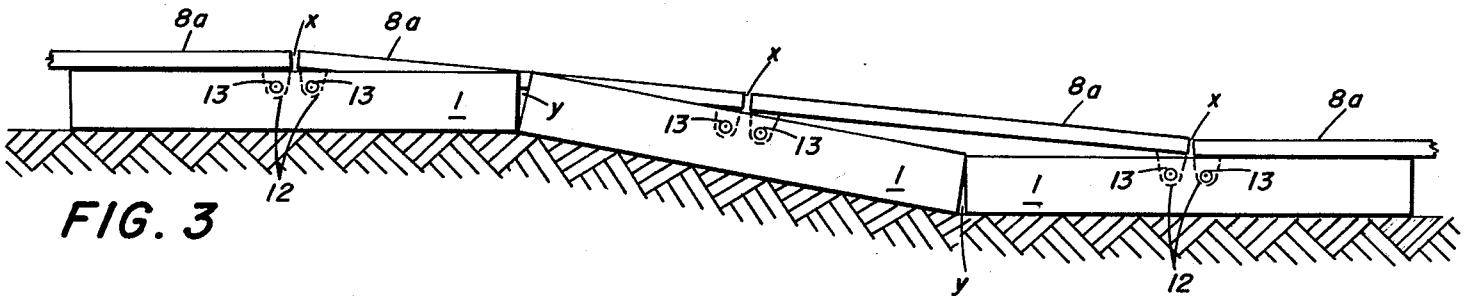
FIG. 3 is an elevational view showing the operative relation between a rack device of the present invention and a face conveyor while engaging a floor having an undulating form.

As previously discussed, shafts 13 are situated directly adjacent the gaps X between individual rack segments 8*a* and at this position, the shafts 13 are located as close as possible to the horizontal plane of symmetry of the cylindrically-shaped drive members 11. Since the joints between the rack segments 8*a* are offset with respect to gaps Y between the ends of the conveyor trough sections, namely, by a distance corresponding to one-half the length of the rack segments, as may be seen in regard to FIGS. 1 and 3, it follows that the vertical displacement between the adjacent ends of the rack segments and the pitch error of the drive members 11 is so small that the meshing relation between the sprocket wheel 14 and the rack segments is not impaired even in the case of an undulating floor as shown in FIG. 3. The rack segments 8*a* which bridge the joint between conveyor trough sections of the conveyor always connect two trough sections so that they are pivotal about shafts 13. Longitudinal relative motions between a rack segment 8*a* and two associated trough sections are, therefore, rendered impossible. The trough sections can only pivot about the mounting shaft 13 as can best be seen in FIG. 3. Since the joints between the conveyor trough sections and the rack segments are offset with respect to each other, it follows that pivoting motions of this kind are transferred only to a limited extent to the rack segments connected to the trough sections. The run of the rack, therefore, corresponds substantially to the path of motion of the sprocket wheel 14 and because the sprocket wheel is supported by the mining machine which extends over several conveyor trough sections, vertical misalignment as well as pitch error of the drive members 11 at the adjacent ends of the rack segments 8*a* are reduced.

A further reduction of the pitch error of the drive members 11 at the joints of the rack segments 8*a* and a reduction to any vertical misalignment between adjacent ends of rack segments can be achieved if the lengths of the rack segments 8*a* are selected to be equal to one-half the length of the conveyor trough sections or spill plate sections as illustrated according to the embodiment shown in FIG. 5. As shown, every second rack segment, namely, the rack segment located in the midsection of a conveyor section forming the face conveyor 1, is rigidly fixed in relation to an associated conveyor trough section. Only the rack segments 8*b* situated between the immovable rack segments 8*a* are arranged symmetrically with respect to the gap Y between conveyor trough sections or spill plate sections. It is to be understood, of course, that the rack segments 8*b* bridge the gap Y and, therefore, only rack segments 8*b* are pivotal about the shafts and self-adjustable with respect to sections of the face conveyor.

Figure 4:
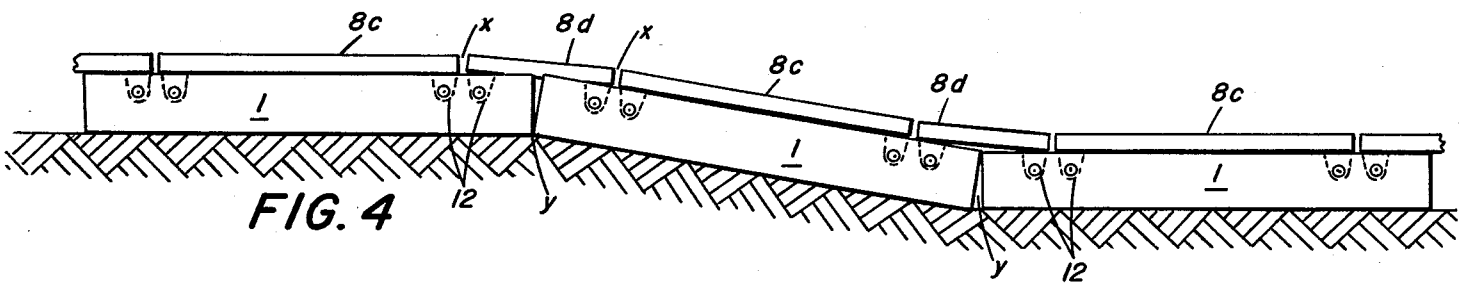
FIG. 4 is a view similar to FIG. 3 but illustrating a different arrnagement of rack segments and lengths thereof to form the rack device of the present invention.

According to the embodiment of the present invention illustrated in FIG. 4, the length of rack segments 8*c* corresponds to three-quarters of the length of a conveyor trough section. The rack segments 8*d* which bridge the gaps Y between conveyor trough sections on the other hand have a length equal to one-quarter of the length of a conveyor trough section. In this embodiment, the gaps Y between conveyor trough sections are also situated accurately along the longitudinal center of one rack segment 8*d*, namely, the shorter rack segment which together with the longer rack segment 8*c* completes one rack segment and corresponds to the full length of a conveyor trough section. In all embodiments of the present invention explained thus far, the individual rack segments 8*a*–8*d* are mounted independently of each other within the duct 2.

Figure 6:
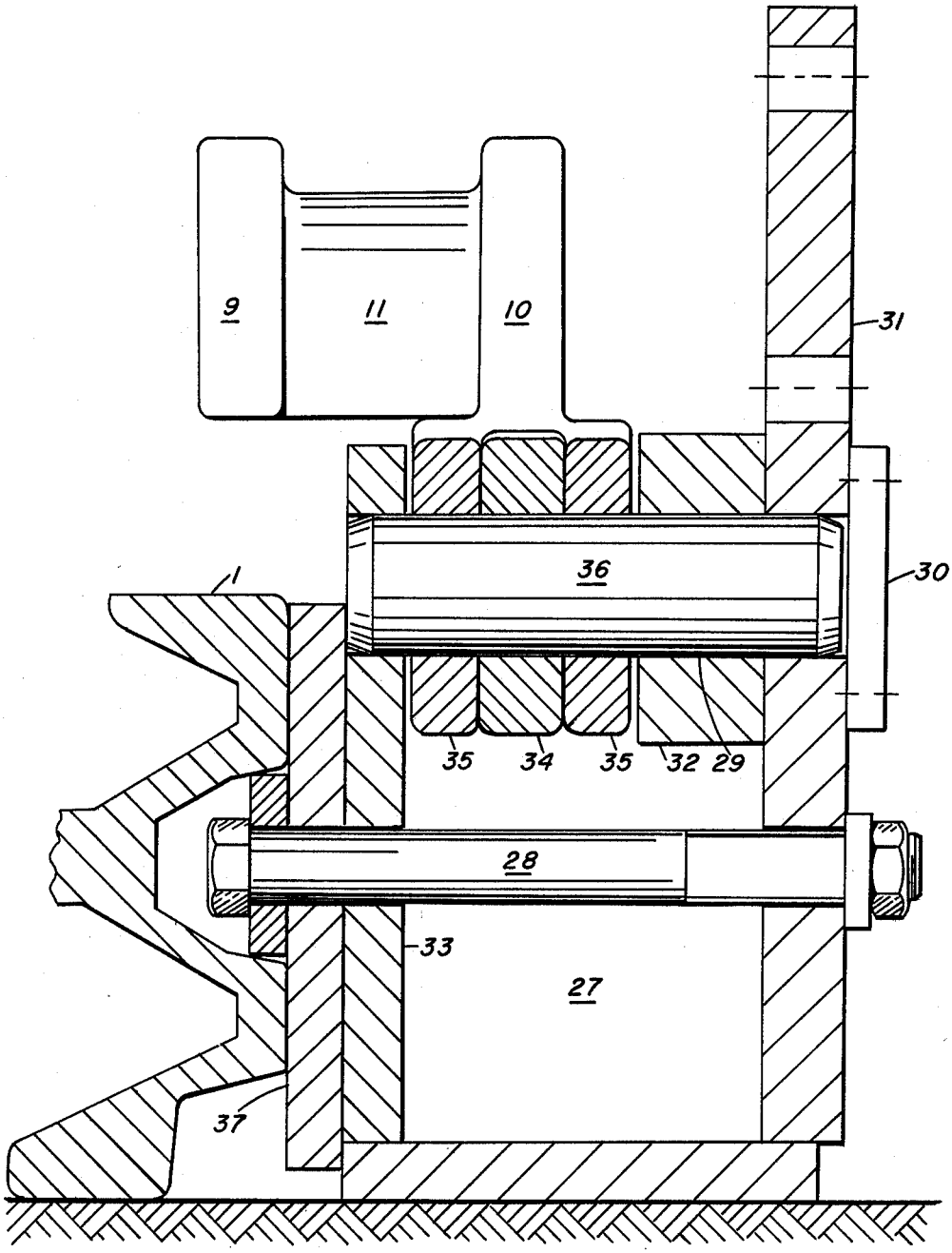
FIG. 6 is a sectional view taken along line VI—VI of FIG. 5.

In the embodiment of the present invention illustrated in FIGS. 5 and 6, a box-shaped duct 27 is made from individual duct portions which are also connected to the face conveyor 1 by means of bolt-type fasteners 28. The duct 27 includes transversely-arranged bores 29 which are closed at the stow side of the conveyor by plates 30 and, in turn, secured to wall 31. The wall 31 forms a support for the side spill plate, not shown. As illustrated in FIG. 5, the bore 29 is formed by a series of aligned openings, one of which is located in the wall 31, another being located in a block-shaped member 32 and a third being located in a side wall 33. Walls 31 and 33 as well as member 32 form part of the duct 27. The aligned openings in these members forming the bore 29 have an oval shape which is enlarged in a horizontal direction corresponding to the direction of transportation by the face conveyor. The oval-shaped bore is employed to provide the required pivotal movement of the conveyor trough sections. Extensions 34 which have openings dimensioned to correspond to the bore 29 extend downwardly from a rack segment. The openings in the extensions 34 have a plane of symmetry Z precisely located in the middle of gap X between rack segments 8*a*. As can be seen in FIG. 5, the extensions 34 take the form of a tongue extension that is coupled by a shaft 36 in the space between clevis extensions 35 from an adjacent rack segment 8*a*. The construction and arrangement of parts are such that the clevis extension encloses the sides of a tongue extension while the shaft 36 interconnects two rack segments 8*a* in the manner of a hinge. The shaft 36 also forms an interconnection with walls 31 and 33 in the duct 27. The duct is stiffened by transverse plates 37 which permit relative motion between the rack 8, the duct 27 and the face conveyor 1. This relative motion corresponds to the difference between the diameter of the shaft and the length of the slot 29.

In the embodiment of the present invention illustrated in FIG. 7, the winch 20 on the drum-cutter mining machine 16 is provided at the side wall nearest the stow side, with an endless flat-link chain 40. The chain in directly driven by the sprocket wheel 21 of the winch 20. Sprocket wheels 44 and 45 reverse the path of travel of the chain. These sprocket wheels are supported on a frame 41 of the drum-cutter mining machine 16 so as to be rotatable about shafts 42 and 43. Sprocket wheels 21, 44 and 45 guide the endless flat-link chain. Drive plates 46 extend from the flat-link chain 40 into engagement with the rack 8 by projecting into the space between the drive members 11 for driving engagement therewith. A portion of the flat-link chain extending parallel to the rack in the region between the sprocket wheels 44 and 45 is guided by a strip 47 which also maintains the chain in stretched position for engagement between drive plates 46 and the drive members 11.

Figure 8:
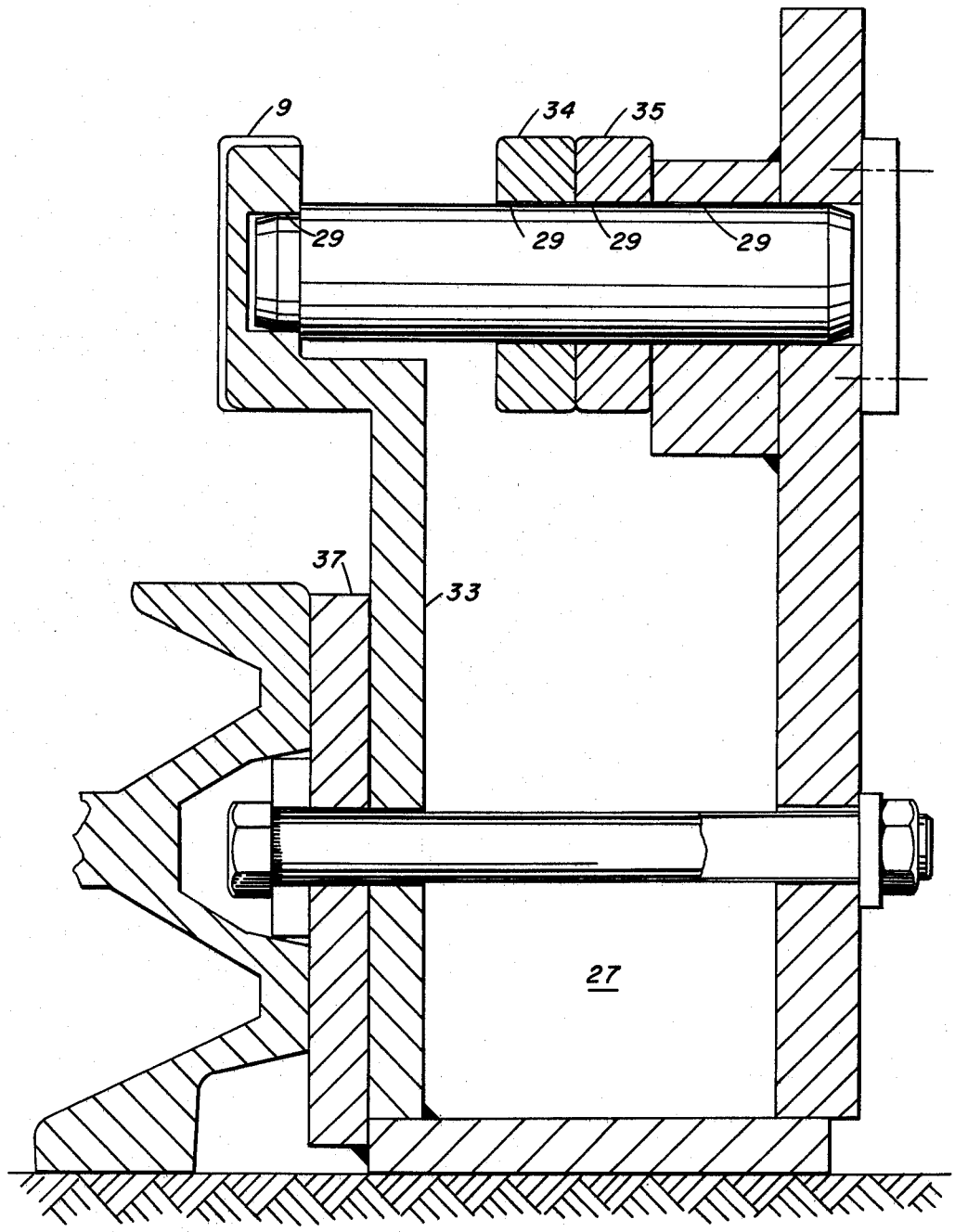
FIG. 8 is a sectional view similar to FIG. 6 but illustrating a further modified form of the rack device according to the present invention.

In the embodiment of the present invention illustrated in FIG. 8, the location of the shaft 36 used to interconnect extensions between two adjacent rack segments is such that the shaft 36 forms a drive member between two adjacent ones of the drive members 11 at the ends of the rack segments. This embodiment of the invention essentially corresponds to the embodiment previously described in regard to FIGS. 5 and 6 except that the shaft 36 is positioned so as to lie in a plane for engagement with the drive member of the drum cutter while additionally serving the primary function of interconnecting the extensions from two adjacent rack segments. It will be apparent that the aligned openings forming the bore 29 remain in an essentially same relation as previously described by providing that wall 33 is extended in a Z-shaped configuration to lie at the gap between the ends of plates 9 of adjacent rack segments. In view of the foregoing, it is believed clearly apparent that shaft 36 may be repositioned so as to carry members on its periphery to form the drive members 11.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In combination with a mining machine, a rack device at the side wall of a face conveyor which includes a plurality of conveyor trough sections arranged end-to-end for extending along a generally horizontal path of travel by the mining machine, said rack device including, in combination:

a plurality of elongated rack segments having spaced-apart drive members along the length of each segment, means connected with at least some of said conveyor sections to support the opposite ends of said rack segments at the side wall of the face conveyor for pivotal movement of each rack segment about horizontal axes, said means carrying the ends of adjacent rack segments in a spaced-apart relation to maintain a gap therebetween, at least some of said rack segments being coupled by said means with conveyor trough sections to bridge and maintain a gap between the ends of adjacent conveyor trough sections for unimpeded vertical movement and horizontal pivotal movement between the conveyor trough sections, and a rotating element on said mining machine for driving engagement with the drive members of said rack segments to propel the mining machine along its course of travel.

2. The combination according to claim 1 wherein said means to support the opposite ends of said rack segments are connected to at least one conveyor trough section.

3. The combination according to claim 1 further including a spill plate defined by spill plate sections arranged side-by-side to extend along said face conveyor, said spill plate sections being connected to at least some of said rack segments by said means to support.

4. The combination according to claim 1 wherein said rotating element includes a driven sprocket wheel carried by said mining machine.

5. The combination according to claim 1 wherein said rotating element includes an endless circulating drive chain carried by said mining machine.

6. The combination according to claim 5 wherein said endless circulating drive chain includes drivers spaced along the length of the chain for engaging at least some of the drive members of said rack segments.

7. The combination according to claim 1 wherein said plurality of elongated rack segments includes individual rack segments having a length approximately corresponding to the length of an individual one of said conveyor trough sections.

8. The combination according to claim 1 wherein said elongated rack segments include individual rack segments having a length approximately corresponding to one-half of the length of an individual one of said conveyor trough sections.

9. The combination according to claim 1 wherein said elongated rack segments include individual rack sections each of which is constructed and arranged such that successively-arranged rack sections have different lengths defining a combined length approximately corresponding to an individual one of said conveyor trough sections.

10. The combination according to claim 9 wherein said rack members having different lengths are arranged such that the shortest rack section bridges and maintains a gap between the ends of adjacent conveyor trough sections.

11. The combination according to claim 1 wherein said plurality of elongated rack segments each further includes two strips joined together in a spaced-apart relation by said drive members, the top surfaces of said strips being tapered to form ramps at the ends of the strips, at least one of said strips including an extension having an opening for receiving said means to support.

12. The combination according to claim 11 wherein said drive members located at the end regions of said rack segments have side surfaces converging toward the bottom edges of said strips.

13. The combination according to claim 11 wherein adjoining rack segments are joined together by said extension and said means to support, and wherein the extensions at the two ends of the adjoining rack segments are symmetrically disposed with respect to the joint by a laterally-displaced relation with respect to each extension.

14. The combination according to claim 11 wherein the extensions at the two ends of adjoining rack segments are connected together by said means to support to form a hinged interconnection between the rack segments.

15. The combination according to claim 1 wherein one of two adjacent rack segments includes a clevis extension and the other of the two adjacent rack segments includes a tongue extension coupled to the clevis extension by said means to support, said means to support being further defined to include a rod member received in an opening within said clevis extension and said tongue extension.

16. The combination according to claim 15 wherein said rod member extends along a horizontal axis lying in a plane containing said drive members.

17. The combination according to claim 15 wherein said rod members interconnect two adjacent rack segments and at least one of said face conveyor sections.

18. The combination according to claim 15 further including a spill plate defined by spill plate sections arranged side-by-side to extend along said face conveyor, at least one of said spill plate sections being connected to said rod member together with the clevis extension and tongue extension of two adjacent rack segments.

19. The combination according to claim 1 further including a spill plate defined by spill plate sections arranged side-by-side to extend along said face conveyor, a duct member disposed between said spill plate and said face conveyor, said duct member including a side wall having an opening for receiving said means to support the opposite ends of said rack segments, said means including rod members extending transversely to the direction of transportation by said face conveyor.

20. The combination according to claim 1 wherein said plurality of elongated rack segments each further includes an extension at each end having an eyelet opening enlarged in the longitudinal direction of the rack segment, a rod member forming part of said means to support said rack segments for joining together two rack segments in an end-to-end relation for limited longitudinal movement relative to an adjacent one of said conveyor trough sections.

21. The combination according to claim 20 further including a duct member generally disposed below said rack segments, said duct member including a side wall having an opening enlarged in the longitudinal direction of the rack segments for receiving said projected end of said rod member for lateral movement along the longitudinal direction of the rack segments.

22. The combination according to claim 1 wherein said mining machine includes machine skids engageable with said rack segments for guiding to prevent vertical and lateral movement relative to the rack segment while the mining machine moves along the rack segments.

* * * * *